US008740222B1

(12) United States Patent
Krzewicki et al.

(10) Patent No.: US 8,740,222 B1
(45) Date of Patent: Jun. 3, 2014

(54) MULTIFUNCTIONAL ELECTRONIC DART BOARD WITH DIGITAL TARGET DISPLAY RING (DTDR)

(76) Inventors: Robert Krzewicki, Sacramento, CA (US); David Allen Hopkins, Sacramento, CA (US)

( * ) Notice: Subject to any disclaimer, the term of this patent is extended or adjusted under 35 U.S.C. 154(b) by 190 days.

(21) Appl. No.: 13/354,868

(22) Filed: Jan. 20, 2012

Related U.S. Application Data

(63) Continuation-in-part of application No. 12/040,885, filed on Mar. 1, 2008, now abandoned.

(51) Int. Cl.
*A63F 9/24* (2006.01)

(52) U.S. Cl.
USPC ..... 273/374; 463/16

(58) Field of Classification Search
None
See application file for complete search history.

(56) References Cited

U.S. PATENT DOCUMENTS

| | | | |
|---|---|---|---|
| 3,850,432 | A | 11/1974 | Crocker |
| D241,665 | S | 9/1976 | Reed |
| D250,215 | S | 11/1978 | Elliot |
| 4,314,703 | A | 2/1982 | Grottola |
| 4,567,461 | A | 1/1986 | Honekman et al. |
| D296,708 | S | 7/1988 | Garrett |
| 4,793,618 | A | 12/1988 | Tillery et al. |
| 5,066,020 | A | 11/1991 | Trudeau |
| D322,290 | S | 12/1991 | Di Venanzo |
| D345,585 | S | 3/1994 | Nelly |
| 5,314,195 | A | 5/1994 | Schulze |
| D354,314 | S | 1/1995 | Steininger |
| 5,377,990 | A | 1/1995 | Seeney-Sullivan |
| 5,401,033 | A | 3/1995 | Lychock |
| 5,540,445 | A | 7/1996 | Lee |
| 5,540,446 | A | 7/1996 | Felsen |
| 5,559,490 | A | 9/1996 | McDonald et al. |
| 5,642,886 | A | 7/1997 | Yancey, Jr. |
| 5,648,752 | A | 7/1997 | Alfrey |
| 5,669,609 | A | 9/1997 | Reichert |
| D397,367 | S | 8/1998 | Barr |
| D400,932 | S | 11/1998 | Yiu |
| D403,361 | S | 12/1998 | Huang |
| 5,967,518 | A | 10/1999 | Rowe |
| 5,975,530 | A | 11/1999 | Gary |
| 6,186,892 | B1 | 2/2001 | Frank et al. |
| 6,406,021 | B1 | 6/2002 | Nadibaidze |
| 6,917,282 | B2 | 7/2005 | Giegerich |
| D514,170 | S | 1/2006 | Kaminkow et al. |
| D544,042 | S | 6/2007 | Sierakowski |
| 7,275,747 | B1 | 10/2007 | Tanita |
| D563,478 | S | 3/2008 | Hanes, III |
| D612,892 | S | 3/2010 | Miele |
| 2002/0135131 | A1 | 9/2002 | Martin et al. |
| 2002/0171204 | A1 | 11/2002 | Martin et al. |
| 2004/0026863 | A1 | 2/2004 | Cho |
| 2004/0090010 | A1 | 5/2004 | Wilson |
| 2005/0006847 | A1 | 1/2005 | Ross |
| 2005/0062232 | A1 | 3/2005 | Pavlik et al. |
| 2006/0151957 | A1 | 7/2006 | Pan et al. |
| 2006/0205471 | A1* | 9/2006 | Martin et al. ..... 463/16 |
| 2008/0012233 | A1 | 1/2008 | Giegerich et al. |
| 2009/0121439 | A1 | 5/2009 | Sierakowski |

* cited by examiner

*Primary Examiner* — Paul A D'Agostino

(57) ABSTRACT

The present invention features a dart board comprising a digital target display ring (DTDR) surrounding a target area. The DTDR is operatively connected to a controller with a microprocessor, wherein said microprocessor is configured to (a) receive an input signal from an input device when the input device is actuated, and (b) generate an output signal to the DTDR for the DTDR to display a unique graphic according to pre-programmed commands for the actuated input device.

3 Claims, 6 Drawing Sheets

GAME MENU

001 - ZEN CRICKET
002 - CRICKET
003 - RANDOM CRICKET
004 - AMERICAN CRICKET
005 - 301
006 - 401
007 - 501
008 - 601
009 - 701
010 - 8-BALL
011 - 9-BALL
012 - STRAIGHT POOL
013 - CARDS (21)
014 - POKER
015 - DICE-5000
016 - DICE-10000
017 - DICE-YAHTZEE
018 - DOMINOES
019 - SHANGHAI
020 - BASEBALL
021 - GOLF
022 - FOOTBALL
023 - ACE
024 - ROUND THE WORLD
025 - NINE DART CENTURY
026 - HORSE
027 - BOWLING
028 - SOCCER
029 - BASKETBALL
030 - HOCKEY
031 - TIC TAC TOE
032 - ODDS & EVENS
033 - HI SCORE

FIG. 4

MULTIFUNCTIONAL ELECTRONIC DART BOARD WITH DIGITAL TARGET DISPLAY RING (DTDR)

CROSS REFERENCE

This application claims priority to U.S. non-provisional application Ser. No. 12/040,885 filed Mar. 1, 2008 as a continuation-in-part, the specification of which is incorporated herein by reference in its entirety.

BACKGROUND OF THE INVENTION

This invention relates to the creation of variations on the conventional dart board for playing of variations on darts such as those that resemble other existing games (cricket, billiards, pool, cards, dice, etc.), and to the design of electronic dart boards.

Various modified dart boards are known, where the dart games are modified to enhance the playing experience. For instance, Yancey (U.S. Pat. No. 5,642,866) discloses a dart board modified to play a simulated golf game where each wedge represents a different hole in a golf course, and the outer ring may be rotated so as to represent different courses, by varying the difficulty of various "holes". Yancey also discloses that such a board may be played in computer simulation with a simulated electronic dart, and with the indicia on the outer ring changing to represent various courses.

In addition, Lee (U.S. Pat. No. 5,540,445) discloses an electronic dart board modified to play cricket, with an electronic scoring display and a number of game selection options, where the impact of a dart on the target area triggers an adjustment in the scoring display.

The one common feature that these electronic dart boards have is that the numerical values surrounding the target area remain static, i.e., the display arrangement is always the standard 20, 1, 18, 4, etc., going clockwise, where 20 is at the 12 o'clock position. Instead, these electronic boards are limited to keeping track of the score according to a variety of rules, and the number of possible games they can be configured to play is limited by the fixed numerals. Yancey discloses a board whose outer ring may be rotated to provide a variety of "courses" of a simulated golf game, but neither Yancey nor Lee disclose an electronic dart board upon which the indices are modifiable in order to play a variety of different games.

Various dart boards are also known which are modified to display dice or cards or billiards (Grottola, U.S. Pat. No. 4,314,703 and Barr, U.S. D 397367), though these indicia are not electronically displayed or made modifiable by electronic controls. Each of these inventions also features only one or two games with fixed or rotatable ring of target graphics, and does not provide for an electronic multi-functional dart board that can be reconfigured for a large number of games, or provide for an interactive game-play experience.

The present invention features a multifunctional electronic dart board with a digital target display ring (DTDR) surrounding the dartboard. The DTDR is capable of displaying graphical images associated with each target, where the graphic display matching up with each segment in the target area may be varied. The graphical image used is dependent on the configuration of the game selection and game options, as well as game events that occur during play. The dart board may be configured by the user to play a number of variations on a variety of dart games, not limited to dice, cards, billiards, cricket, and others. The dart board may also be reprogrammed to provide for new games and options available to the user without modifying the underlying electronics. The board provides for a unique playing experience, where the user is able to uniquely customize the game play experience and where the DTDR provides in-game sound and graphics that enhance the game playing experience.

The present invention is advantageous over the prior art because it provides the capacity to reconfigure the board to play any game that is adaptable to a dart board, including novel games. The present invention also provides a mechanism for altering the target graphics to display unique graphics, as programmed by the manufacturer, making it uniquely accessible to a variety of markets comprised of people who speak various languages. The pre-programmed game options, including target graphics, may be changed to allow different pre-programmed games depending on the games most popular in the local market. The present invention is also novel in that it allows for interactive changes in the target graphics, as well as the production of sound associated with target events, allowing for the user to enjoy a unique game-play experience, and for the board to be configured to provide unique games and styles of play that utilize these interactive events by changing the target graphics during gameplay.

Yancey (U.S. Pat. No. 5,642,866) also discloses an in silica computer simulated version of the golf game, which may be modified to display further variations in the indicia in order to represent a greater variety of simulated golf courses. As is clear from the text (Column 3, line 53-56) Yancey's computer simulation of a dart game is not substantially equivalent to an electronically controlled dart board, since it involves a simulated dart thrown at a simulated board. (For example, using a Wii controller to emulate a dart throwing motion towards a computer monitor displaying a dartboard graphic.) Although, a computerized dart game may involve a processor core, a control bus, and a monitor that displays graphics, these electronics are standard to any personal computer or game system, and are below the level of the operating system and thus invisible to the software developer. These electronics are also specialized for personal computers and could not be interfaced directly to a physical electronic dart board without substantial accessories (such as an A/D converter). The use of a computer to simulate a dart game and modify graphics associated with the targets thus does not make obvious the use of an electronically controlled target display ring around a physical dart board, which physical darts are thrown at. Furthermore, the game play experience of a computer simulated dart game is generally considered inferior by dart players, due to the inability to accurately replicate the physical feel and weight of the dart or the physics of an actual darts flight (for instance, eliminating finer aspects of control such as spin). Targeting skill in a simulated dart game is hence incapable of transferring to a physical dart board and vice versa. Thus, there remains a need in the market for a physical electronic dart board which can be reconfigured to play a multitude of games.

BRIEF DESCRIPTION OF THE DRAWINGS

FIG. 4 shows a game menu for the game selection.

DESCRIPTION OF PREFERRED EMBODIMENTS

Figure 1:
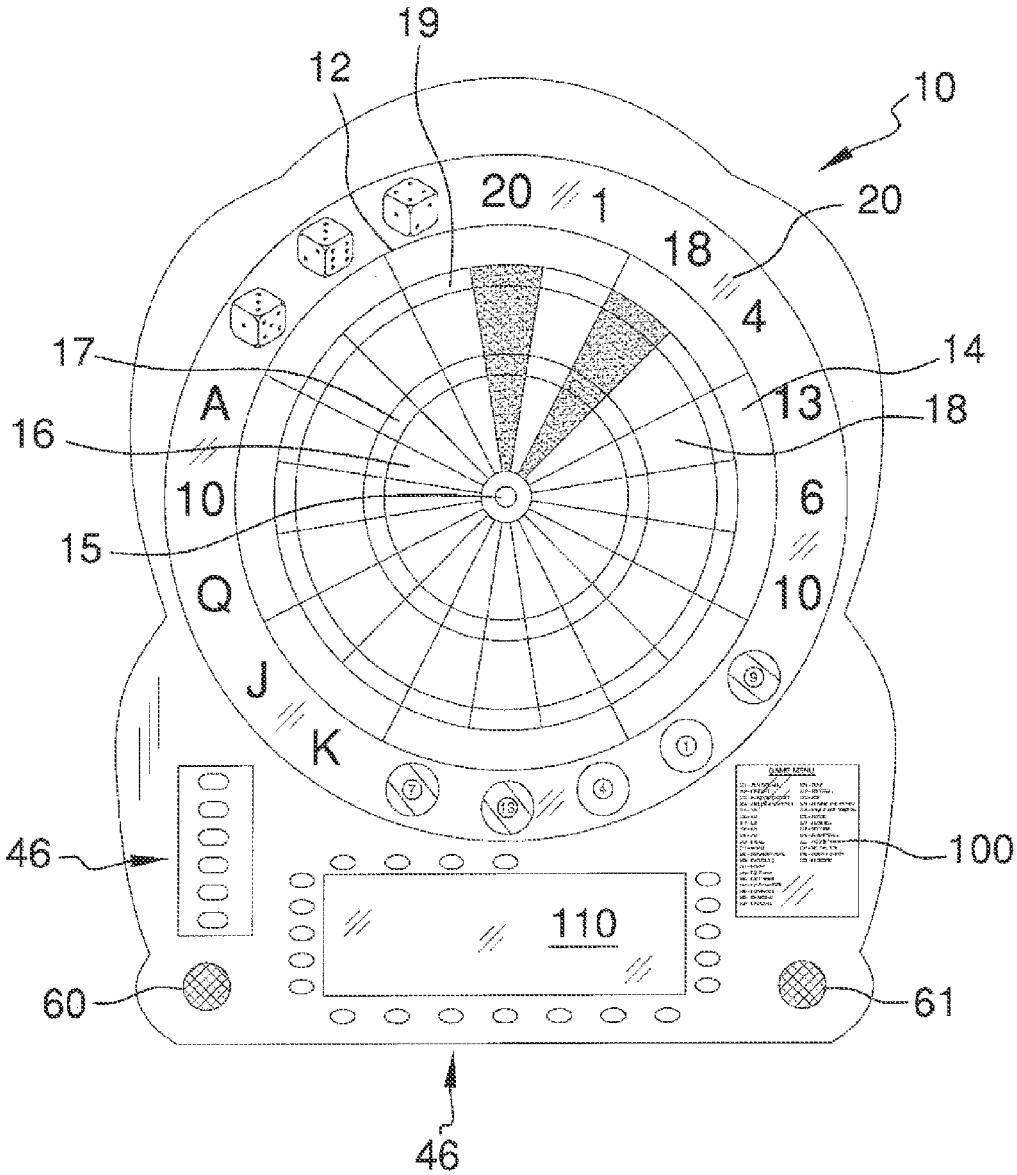
FIG. 1 shows a dart board comprising a digital target display ring (DTDR) surrounding a target area. The DTDR may display various graphics in various arrangements around the target area, which may be modified during game play in response to target strike events. The DTDR shows the various possible exemplary graphics that may be displayed, e.g., numerical values, pool balls having certain numbers, dice, etc.
Figure 2:
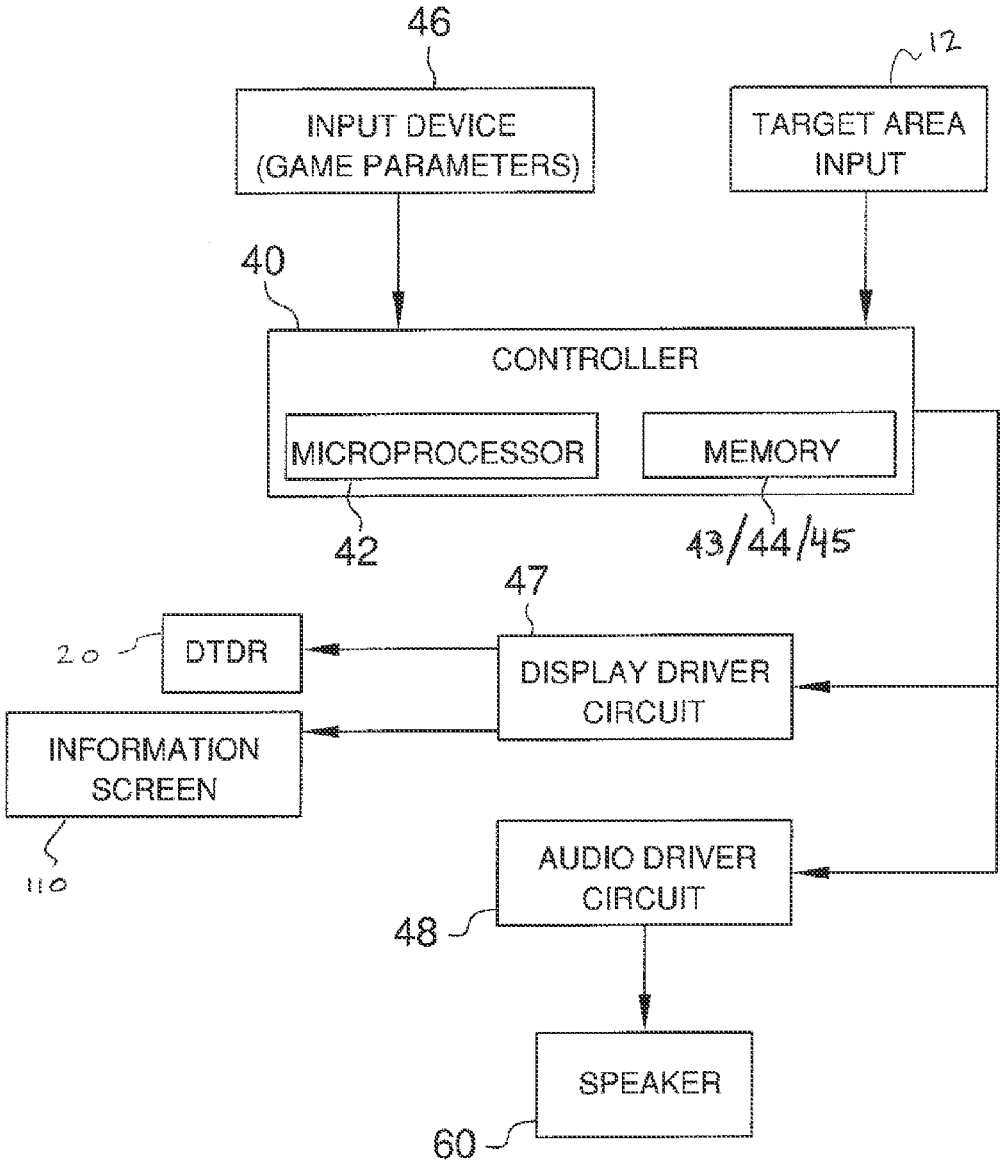
FIG. 2 shows a block diagram of the electrical components, wherein the DTDR is operatively connected to a controller with a microprocessor and said microprocessor is configured to (a) receive an input signal from an input device when the input device is actuated, or from the target device when a target is struck by a dart, and (b) generate an output signal to the DTDR for the DTDR to display a unique graphic according to pre-programmed commands for the actuated input device, depending on the type of game, the game options selected, and the target event.
Figure 3:
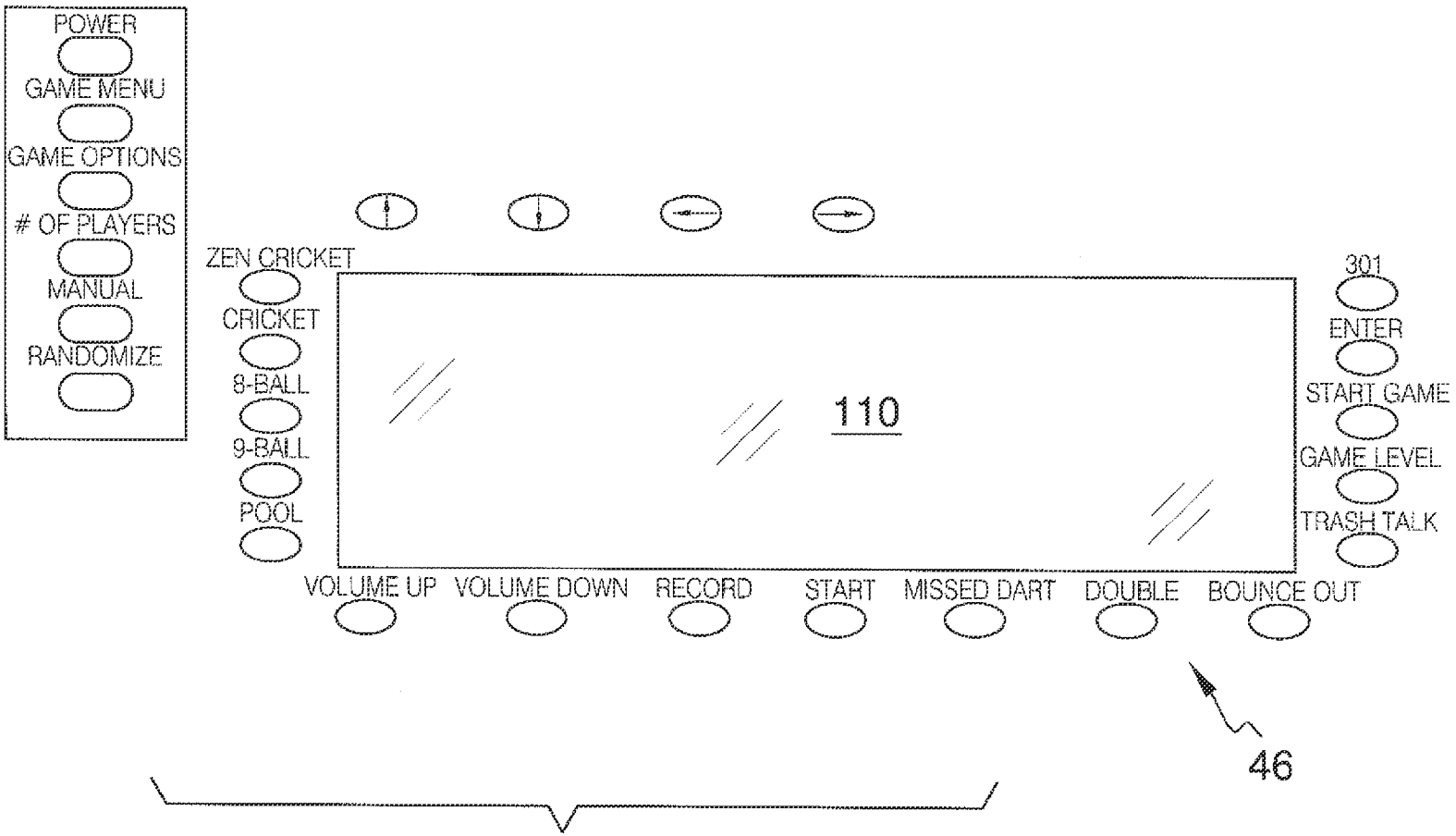
FIG. 3 shows an enlarged visual presentation of the lower portion of the dart board shown in FIG. 1. The input device of the present invention includes a game option selection and a game level selection.

The present invention features a dart board comprising a digital target display ring ("DTDR") for enhancing a player's playing experience. A dart board 10 in accordance with the present invention as shown in FIG. 1 comprises a target area 12 surrounded by a digital target display ring (DTDR) 20.

To initiate the game, a player enters various game parameters via the input device 46 (e.g., buttons and the like). Various parameters may be entered (discussed below), but the two main parameters are game type (e.g., Zen Cricket, 8-Ball, Pool, etc.) and game level. The input device 46 communicates with the controller 40, which comprises a microprocessor 42 and memory 43. The electrical components and communication of the present invention may be configured in any appropriate manner known to one of ordinary skill, see for example, U.S. Pat. No. 5,401,033, the entire disclosure of which is incorporated by reference herein.

Figure 5:
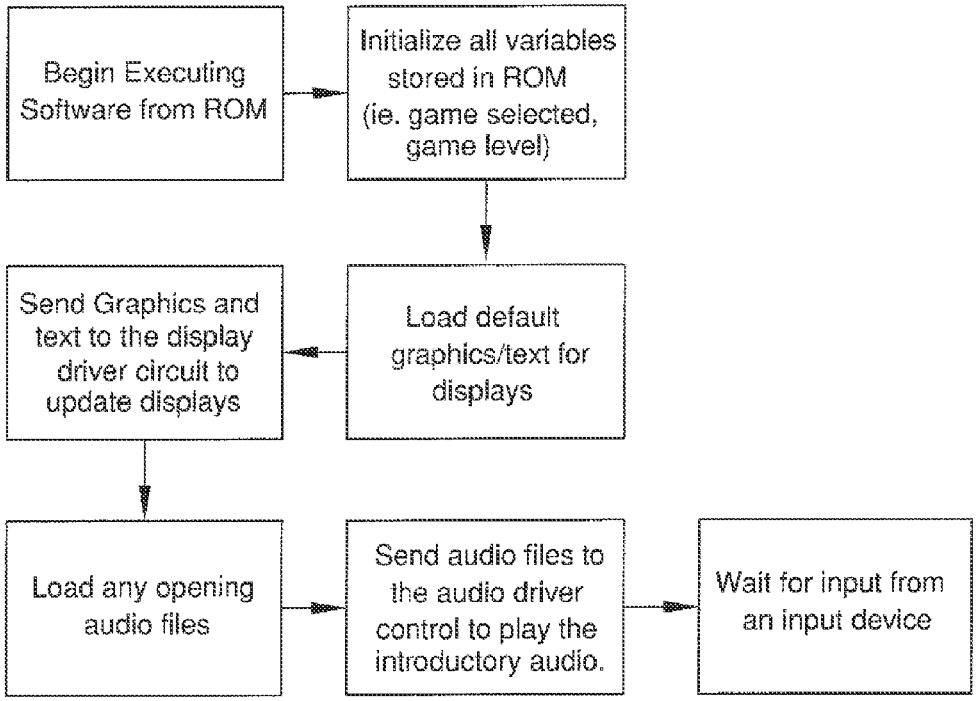
FIG. 5 shows a schematic diagram of how software may be used to initialize some or all of the dart board's parameters, e.g., set the displays such as the DTDR to display the default graphics, initialize all of the variables that will be stored in RAM 45, and request that the player select a game.

The microprocessor 42 is configured to receive instructions from the input devices and execute software from the memory 43 (e.g., ROM) for the selected parameter (e.g., game type and game level). The memory 43 may include, but is not limited to both non-volatile, read only memory (ROM) 44 for storing software data, and random access memory (RAM) 45 for temporary storage during execution. It is possible that other types of memory may be included, such as flash memory, in addition to, or in replace of the previously mentioned technology. Once the dart board is switched on, the microprocessor 42 will begin executing the initialization code stored in ROM 44. In some embodiments, a commercial microcontroller is used to act as the controller, and the software may be written in either assembly, or a specialized high-level language designed specifically for the particular controller. For ease of use by the programmer, a controller whose programming language is based on a more common language, such as C, may be employed. This code may be used to initialize some or all of the dart board's parameters, e.g., set the displays such as the DTDR to display the default graphics, initialize all of the variables that will be stored in RAM 45, and request that the player select a game (FIG. 5). Once all initialization parameters have been set, the software would wait for player input.

Figure 6:
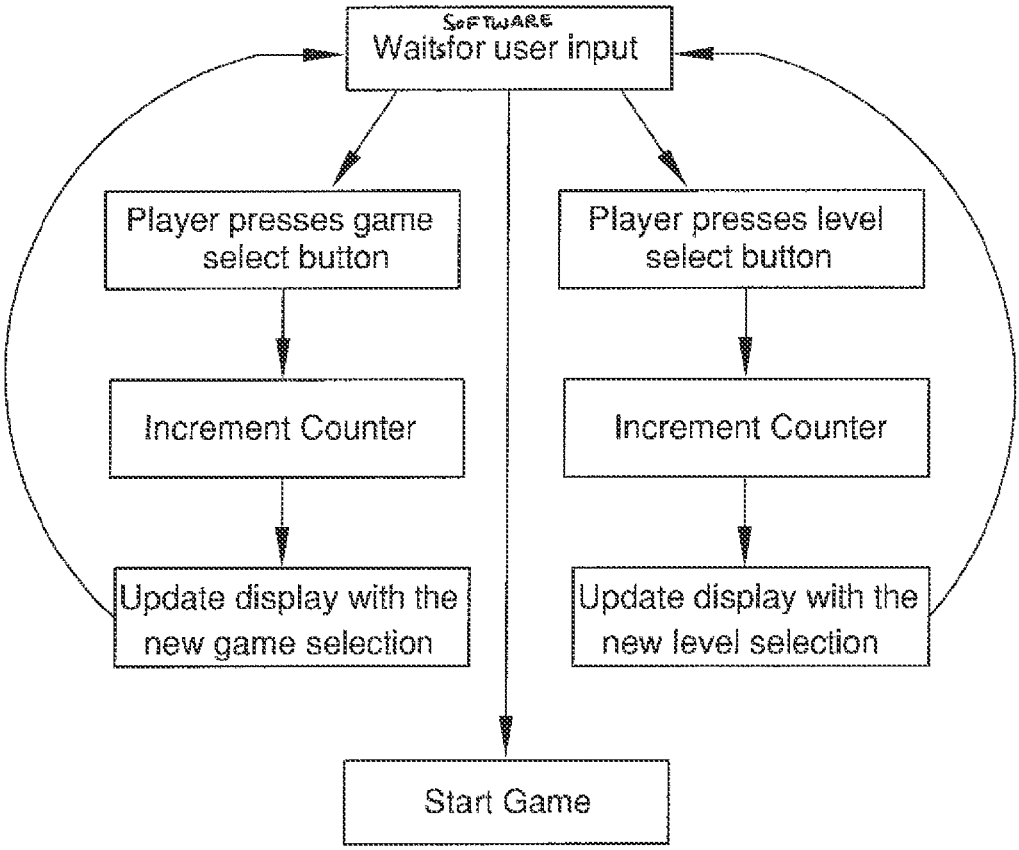
FIG. 6 shows a schematic diagram of how a software waits for an input from the user, to process the start of game.

When the digital dart board is waiting for user input, the player will then be able to press the appropriate buttons on the input device 46 to select the appropriate game options (e.g., the game type and level; FIG. 6). Every time the controller 40 receives an input from the input device 46, it will update the appropriate variables in stored in RAM 45. If the game select button is pressed, the game will update the counter with the new index number of the next game type. It will then update the display with the new game name via the display driver circuit 47. If the level select button is pressed, the game will update the level counter with the new index number of the next level. It will then update the display via the display driver circuit 47 with the new level number. As part of its execution of the software from ROM 44, the microprocessor also obtains the appropriate graphic file from ROM 44, sends the information to a display driver circuit 47 which instructs the DTDR to display specific game characters (e.g., numbers, billiard balls, dice, cards, etc.) in accordance with the game parameter selected. Optionally, the display driver circuit 47 additionally instructs the information screen 110 to display relevant game information, e.g., game selected, scores, game level, etc. Once the player has selected the desired game type and level, the player may then select the start game button to begin play.

In some embodiments, the microprocessor obtains the appropriate sound file from ROM 44, sends the information to an audio driver circuit 48 which instructs the speakers to play specific game sounds associated with the selected game parameters.

The target area may have various scoring regions, wherein each scoring region has a sensor that can detect an impact of a dart when the dart is thrown and hits that region. In some embodiments, a sensor may be in the form of a switch that is depressed when a dart hits the scoring region. Examples of switches that may be used in accordance with the present invention may be found in U.S. Pat. No. 4,057,251, the entire disclosure of which is incorporated in its entirety herein by reference. When a sensor detects an impact of a dart (ie. a switch is depressed), it sends a signal to the controller. Once the controller receives this signal from the target area, it processes it in accordance with the software instructions for the selected game parameter, e.g., displaying a score, adding points, displaying a graphic, playing a sound, etc. In some embodiments, the target area remains static and does not have an altering graphic display. For example, as opposed to the DTDR which has an altering graphic display, the target area does not.

In some embodiments, the target area 12 comprises 20 pie sections, each pie section comprising a sensor to detect an impact of a dart. In some embodiments, the target area comprises scoring segments (each comprising a sensor to detect an impact of a dart), wherein the scoring segments may further comprise (a) a bull's-eye 15, (b) a first area 16 (single ring) surrounding the bull's-eye, wherein the first area comprises a plurality of scoring segments, (c) a second area 17 (triple ring) surrounding the first area, wherein the second area comprises a plurality of scoring segments, (d) a third area 18 (single ring) surrounding the second area, wherein the third area comprises a plurality of scoring segments, (e) a fourth area 19 (double ring) surrounding the third area, wherein the fourth area comprises a plurality of scoring segments, and (f) optionally, a fifth non-scoring area 14 surrounding the fourth area for miss thrown darts, wherein the scoring segments are radially aligned within twenty pie sections.

The target area 12 is operatively coupled to a controller 40 which controls the play of the game as well as the scoring. The controller 40 comprises a microprocessor 42 that operates according to the software stored in memory 43. The controller 40 is responsive to input devices 46 such as buttons (or switches, and the like) on the device for controlling game being played.

Any game that is adaptable to a dart board may be played with the present dart board having a DTDR. Non-limiting examples of games are shown on game menu (FIG. 4).

Various player parameters and options may be set with the input device 46. In some embodiments, the input device comprises one or more of the following buttons shown in FIG. 4. The buttons shown in FIG. 4 are examples only and are not limiting, e.g., a dart board of the present invention may comprise fewer or more buttons shown in FIG. 4. In some embodiments, the buttons shown in FIG. 4 function as follows:

Power Button (ON/OFF)—Press to turn game on or off. Dartboard has an automatic suspend mode to conserve power and battery life. The automatic suspend mode will activate after 5 minutes of non-use. However, the scores are stored in memory and can be retrieved by pressing any button.

Game Menu—This button will activate the game menu function to allow the players to choose one of many games associated with the board Game Options—Press this button to select varying options for each game played. After a game, number of players and level is selected; players may need to add options to a game. The options that come up when this button is pushed depends on the game and level selected. Options can include but are not limited to (1) "Clockwise": which will rotate the images generated on the DTDR in a clockwise motion (e.g., rotating the individual images on the DTDR one space clockwise each time the option button is selected), (2) "Counter Clockwise": which will rotate the images generated on the DTDR in a counter clockwise motion (e.g., moving the DTDR in a counter clockwise motion one space each time the option button is selected), (3) "Random": which will rotate the images generated on the DTDR in a random motion (e.g., moving the DTDR in a clockwise or counter clockwise motion two spaces each time the option button is selected), (4) "Points": which when playing games such as Cricket will allow for points to be added up by players against opponents. In some embodiments, to move through the Options menu, a player can press and release the Option button quickly (with each quick press bringing up a new option, e.g., "Clockwise", "Counter Clockwise", etc.). To choose an option (e.g. "Clockwise") from the options menu, a player can press and hold the button for a longer duration, e.g., 2 seconds, when that particular option is visible.

Number of Players—This button is used at the beginning of each game to select the number of players that want to play the game. Up to 8 players able to play.

Manual Button—This button will allow the players to "Manually" place the numbers or graphics 1 through 20 inside of the DTDR. This feature, when pressed, will hold the "graphic segments for game" 1-20 in memory. When a player taps a scoring section with a dart, it registers on the IC board, which sends a signal to the memory; the first "graphic segment for game" in the series 1-20 (example 1) will be placed there and will be removed from the memory. Then the player will tap another scoring area of their choosing which will place the second "graphic segment for game" in the series 1-20 (example 2) in that area on the DTDR and so on until all 20 "graphic segments for game" have been chosen by the player. The game will then be played with the numbers in that order until another command is given to override that command.

Randomize Button—Each time this button is pressed it will automatically randomize the order in which the numbers, graphics and/or characters appear on the DTDR, which will then stay in their respective order until another command is given to the board.

Start Button—This multi-function button is used to START the game when all options have been selected and to CHANGE to the next player when one player is finished throwing their darts.

Missed Dart—If a dart misses the target area, it will not register on the board. Press this button to register that an additional dart hit the board so the board can move to the next task Volume Control—UP—This button will raise the volume of the board's audio Volume Control—DOWN—This button lower the volume of the board's audio Bounce Out—Sometimes darts do not remain in the scoring section and fall out but scores a successful hit due to hitting the target area. If a player does not want to have that score registered, they press the Bounce Out button immediately afterward to deduct that score.

Double Button—This button is used to activate the Double In/Double Out option for the games.

Trash Talk Button—Press this to activate different levels of interactive sound effects.

Record button—Press this button to activate the recording option, which allows a player to record their voice, for example up to 10 seconds of their voice, which is then placed into the Trash Talk memory.

Quick Buttons—These are buttons pre-programmed to bring up various games such as (Zen Cricket, 8-Ball, 9-Ball, Cricket, Straight Pool, 301, etc.)

Many different game levels can be created and played in accordance with the present invention. Each different level for the respective game has different rules for gameplay, and each of these different sets of rules would be coded in software and stored in ROM. In some embodiments, the various game level may be as as follows:

Level One: DTDR remains fixed (Normal game display stays stationary through out game)—With this Level, players have the option of using the Randomize or Manual Set button which will allow them to place the graphics randomly or manually in a different order within the DTDR. This level can be used with any game on board.

Level Two: DTDR rotates after each round of play. If there are multiple players, this takes place after the final player has taken their turn. (Numbers or graphics will rotate "clockwise, counterclockwise or both", uniformly in the "same colored" target segments). In the Game Options area, the players get to choose "clockwise", "counter-clockwise", 2 spaces, 4 spaces, 6 spaces, etc. or Random generation which will follow the rules for this level ("same colored" target segments). e.g. Before game play, player chooses Zen Cricket in the Game Menu, chooses the Level of Difficulty with the Level button, then with the Game Options button the players choose "clockwise", "2 Spaces". After each round of play, the 20 (normally positioned at the top center of the board) will rotate 2 colored segments to the right "clockwise" to rest in the area normally reserved for the number 18 (same colored area), which will in turn rotate the placement of every number on the board 2 spaces to the right after each round of play. This level can be used with any game on board.

Level Three: DTDR rotates after each round of play. If there are multiple players, this takes place after the final player has taken their turn. (Numbers or graphics will rotate "clockwise, counterclockwise or both", uniformly into any of the target segments). In the Game Options area the players get to choose "clockwise", "counter-clockwise", 1 spaces, 2 spaces, 3 spaces, etc. or Random generation—e.g. Before game play, player chooses Zen Cricket in the Game Menu, chooses the Level of Difficulty with the Level button, then with the Game Options button the players choose "clockwise", "Random". After 1 round of play, the 20 (normally positioned at the top center of the board) will rotate to the right "clockwise" to the position traditionally held by the number 6 which will in turn rotate the placement of every number on the board 5 spaces to the right after the $1^{st}$ round of play. After the $2^{nd}$ round of play, this procedure repeats itself and so on until the game is finished.

Level Four: DTDR varies numbers or graphics after each round of play described as; if there are multiple players, this takes place after the final player has taken their turn. (Numbers or graphics will reposition themselves randomly on any of the 20 target segments.) e.g. There are 3 players and The Game 8-Ball is chosen in the Game Menu, # of Players are chosen, and Level Four difficulty is chosen. After the $3^{rd}$ player throws their darts, the DTDR will then display all of the billiard ball graphics in a new position within the DTDR before player 1 takes there turn for the $2^{nd}$ round of play.

Level Five: DTDR rotates numbers or graphics after each player finishes theft turn described as, when a player throws all three of theft darts at the dartboard. (Numbers or graphics will rotate "clockwise, counterclockwise or both", uniformly in the "same colored" target segments). In the Game Options area the players get to choose "clockwise", "counter-clockwise", 2 spaces, 4 spaces, 6 spaces, etc. or Random generation, as long as it remains in the same colored target segment area. —e.g. Before game play, player chooses Zen Cricket in the Game Menu, chooses the Level of Difficulty with the Level button, then with the Game Options button the players choose "clockwise", "2 Spaces". After each player finishes their turn, the 20 (normally positioned at the top center of the board) will rotate 2 colored segments to the right "clockwise" to rest in the area normally reserved for the number 18 (same colored area), which will in turn rotate the placement of every number on the board 2 spaces to the right after each player finishes their turn. This level can be used with any game on board.

Level Six: DTDR varies numbers or graphics after each player throws described as; when a player throws all three of their darts at the dartboard. (Numbers or graphics will rotate "clockwise, counterclockwise or both", uniformly into any of the target segments). In the Game Options area the players get to choose "clockwise", "counter-clockwise", 1 spaces, 2 spaces, 3 spaces, etc. or Random generation—e.g. Before game play, player chooses Zen Cricket in the Game Menu, chooses the Level of Difficulty with the Level button, then with the Game Options button the players choose "clockwise", "Random". After $1^{st}$ player finishes their turn, the 20 (normally positioned at the top center of the board) will rotate to the right "clockwise" to the position traditionally held by the number 6 which will in turn rotate the placement of every number on the board 5 spaces to the right after the $1^{st}$ player completes their turn. After the $2^{nd}$ player completes their turn, this procedure repeats itself and so on until the game is finished.

Level Seven: DTDR varies numbers or graphics after each player throws described as; when a player throws all three of their darts at the dartboard. (Numbers or graphics will reposition themselves randomly on any of the 20 target segments.) e.g. There are 3 players and The Game 8-Ball is chosen in the Game Menu, # of Players are chosen, and Level Seven difficulty is chosen. After the $1^{st}$ player throws their darts, the DTDR will then display all of the billiard ball graphics in a new position within the DTDR before player 2 takes their turn.

Level Eight: DTDR rotates after each dart thrown described as; Player 1 throws their first dart. (Numbers or graphics will rotate "clockwise, counterclockwise or both", uniformly in the "same colored" target segments). In the Game Options area the players get to choose "clockwise", "counter-clockwise", 2 spaces, 4 spaces, 6 spaces, etc. or Random generation, as long as it remains in the same colored target segment area. —e.g. Before game play, player chooses Zen Cricket in the Game Menu, chooses the Level of Difficulty with the Level button, then with the Game Options button the players choose "clockwise", "2 Spaces". After each dart is thrown, the 20 (normally positioned at the top center of the board) will rotate 2 colored segments to the right "clockwise" to rest in the area normally reserved for the number 18 (same colored area), which will in turn rotate the placement of every number on the board 2 spaces to the right after each dart is thrown. This level can be used with any game on board.

Level Nine: DTDR rotates after each dart thrown described as; Player 1 throws their first dart. (Numbers or graphics will rotate "clockwise, counterclockwise or both", uniformly into any of the target segments). In the Game Options area the players get to choose "clockwise", "counter-clockwise", 1 spaces, 2 spaces, 3 spaces, etc. or Random generation—e.g. Before game play, player chooses Zen Cricket in the Game Menu, chooses the Level of Difficulty with the Level button, then with the Game Options button the players choose "clockwise", "Random". After $1^{st}$ dart is thrown and scores, the 20 (normally positioned at the top center of the board) will rotate to the right "clockwise" to the position traditionally held by the number 6 which will in turn rotate the placement of every number on the board 5 spaces to the right after the $1^{st}$ dart is thrown and before the $2^{nd}$ dart is thrown. After the $2^{nd}$ dart is thrown, this procedure repeats itself and so on until the game is finished.

Level Ten: DTDR varies numbers or graphics after each dart thrown described as; Player 1 throws their first dart. (Numbers or graphics will reposition themselves randomly on any of the 20 target segments.) e.g. There are 3 players and The Game 8-Ball is chosen in the Game Menu, # of Players are chosen, and Level Ten difficulty is chosen. After the $1^{st}$ player throws their first dart, the DTDR will then display all of the billiard ball graphics in a new position within the DTDR before the $2^{nd}$ dart is thrown.

Zen-Master Level: This level allows for time settings to be applied to Levels Eight, Nine and Ten. Based on the time setting chosen (e.g. 1-10 second intervals), the player only has a set amount of time to throw their darts at the board before the DTDR changes the number and/or graphic positioning on the board depending on the Level chosen. The countdown happens after the first thrown dart for each player. e.g. The Game Zen Cricket is chosen for 2 players. The Master Level is added to difficulty level Ten and a 3-second interval is chosen. Once Player 1 throws their first dart at chosen target area, Player 1 then only has a maximum of 3 seconds to locate, aim, and throw their dart at chosen target area before the DTDR changes again. If dart is not thrown within that period of time the player will lose that throw.

Using the above options, the player(s) may thus configure the board for a large number of different game variations, in some cases potentially using combinations of variations to create entirely new, unique games, supported by the graphics and scoring abilities of the DTDR and board. The number of possible games is limited only by the combinatorial possibilities of the various options.

Any appropriate display technologies may be employed to construct the DTDR 20 of the present invention. For example, the DTDR 20 of the present invention may be constructed using any of the following display technologies: liquid crystal display (LCD), thin film transistor liquid crystal display (TFT LCD), active matrix liquid crystal display (AMLCD), light emitting diode (LED), organic light emitting diode (OLED), active matrix organic light emitting diode (AMOLED), surface-conduction electron-emitter display (SED), field emission display (FED), electrophoretic display (ED), vacuum florescent display (VFD), interferometric modulation (IMOD), and Electronic Paper Display (EPD), or any other future digital display technology. The display driver circuit 47 may comprise two parts. One general driver circuit responsible for controlling each scoring bed's display as well as the scoring display, and a more specific, display specific driver circuit for handling any and all display specific processing. The display specific driver circuit would ultimately be responsible for updating its specific display. By breaking the display driver circuit into components, the display technology can easily be changed based on changing market conditions to decrease production costs. This DTDR 20 will likely initially be comprised of multiple smaller displays adjacent to form a ring. However, as market conditions change, it may become feasible to design one continuous display with a hole in the center for the dartboard. This continuous display would be ideal, so that there is no gap between displays, however since the display driver circuit is broken into separate components, even if the dart board initially utilizes separate displays, it can later be changed to accommodate one large display with minimal changes to the rest of the unit.

EXAMPLES

Example 1

Playing Zen Cricket with Dart Board Having Digital Target Display Ring

Players can initiate and play Zen Cricket in accordance with the present invention as follows. Board is turned on with Power Button. Game Menu Button is pushed which brings up the ability to choose a pre-defined game. Player can scroll to the desired game, e.g., Zen Cricket, and then push the "enter" button. Zen Cricket is chosen from Game Menu. 4 Players are chosen from the # of Players Button—pressing this button consecutively 4 times will tell the board there are 4 players in the game. If the board allows for 8 players, pressing this button 9 times will begin the player selection all over from 1 player, 6 presses 6 players, etc.

Difficulty Level 8 is chosen by using the Level Button and pressing it 8 times—see Level Descriptions—if the Level Button is not pushed it will by default be placed on Difficulty Level 1. By pressing the Level Button 1 time—this will take it to Level 1 and so on. The Options of the game "Both (Clockwise/Counter Clockwise)", "6 Spaces" and Points are chosen—this will rotate the numbers on the DTDR throughout the game either clockwise or counterclockwise 6 spaces after each dart is thrown. Start Button is pressed to begin game play. Player 1 throws Dart 1. (The object of the game Zen Cricket is similar to Traditional Cricket in that each player is attempting to score 3 darts in the following numbers 20, 19, 18, 17, 16, 15 and the Bull's-eye. This will "close out" that number. This can be done by scoring in the single, double and/or triple area of each scoring segment on the target area of the board.) After the $1^{st}$ dart is thrown, Player 1's dart scores inside of the Double Ring of the 20, a score of 2 hits is registered on the monitor area of the board with an X in the 20 areas. (When a player closes out a number the graphic that displays is usually an X surrounded by a circle. 1 diagonal line for 1 hit, 1 diagonal line completing the X for a $2^{nd}$ hit and the circle surrounding signifying 3 hits). Player 1 now needs only to hit the 20 once more to "close out" the 20's. After the $1^{st}$ dart is thrown, the number graphics on the DTDR rotate to a pre-defined position as chosen by the Difficulty Level and Options, in effect moving the number 20 away from the original area, causing Player 1 to re-adjust the throw to hit another area of the board. Player 1 throws Dart 2 which scores a single hit on the 18. Since 20's and 19's are not closed out, this dart does not count as a score for 18. However, because the $2^{nd}$ dart was thrown, the program of the Difficulty level takes over once again and the numerical graphics change position within the DTDR. Any prior darts that are still stuck in the target area after the DTDR changes and happen by chance to be in the intended target for next throw will be cancelled as a point(s) automatically by the game controller. Player 1 throws Dart 3 which scores a triple hit on the 20. This "closes out" Player 1's 20's and gives Player 1 40 points. After Dart 3 is thrown, the program changes the position of the numbers within the DTDR before Player 2 begins their turn. Game play continues this way throughout the entire game until all numbers 20, 19, 18, 17, 16, 15 and Bulls-eye are closed out by one of the players, which will win them the game.

Example 1

Playing 9-Ball with Dart Board Having Digital Target Display Ring

Player turns on board with Power Button. Game Menu Button is pushed which brings up the ability to choose a pre-defined game. 9-Ball is chosen from Game Menu. 2 Players are chosen from the # of Players Button—pressing this button consecutively 2 times will tell the board there are 2 players in the game. If the board allows for 8 players, pressing this button 9 times will begin the player selection all over from 1 player, 6 presses=6 players, etc. Difficulty Level 4 is chosen by using the Level Button and pressing it 4 times—see Level Descriptions—if the Level Button is not pushed it will by default be placed on the pre-determined level of difficulty for that game (This game is typically a level 8 game). By pressing the Level Button 1 time—this will take it to Level 1 and so on. Game options single, double, or triple to sink ball is chosen as "single". Start Button is pressed to begin game play. Player 1 throws Dart 1. (The object of the game 9-Ball is similar to the traditional game Rotation "Around The World" where the players are attempting to hit each ball once to move onto the next ball in succession. If the player scores "sinks" each ball consecutively with their darts, they are able to retrieve their 3 darts and throw again until they miss the ball they are aiming for or a cue ball "scratch" which will then end their turn). After the $1^{st}$ dart is thrown, Player 1's dart scores inside of the 1-Ball "sinking it". The player 1 throws their second dart hitting the 8-Ball. Their turn is over since they did not hit the 2-Ball. Player 2 throws Dart 1 and hits the 2-Ball, Dart 2 and hits the 3-Ball, Dart 3 and hits the 4-Ball. Player 2 now retrieves their darts and begins again aiming for the 5-Ball. Player 2 misses and scores on the Cue Ball. Player 2's turn is now over. Because the Difficulty Level 4 was chosen, since it is the end of Round 1, all of the billiard balls move from their original position within the DTDR and now come to stop in a randomly generated position. Game play continues this way throughout the entire game until all 1, 2, 3, 4, 5, 6, 7, 8, and 9 are "sunk" by the players. The player that sinks the 9-ball is the player that wins the game.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An interactive multifunctional dart board system programmable to play a plurality of games, the system comprising:

a) a target device 12 to receive dart impact signals on a dart impact area;

b) a digital target display ring (DTDR) surrounding the target device 12 to display a plurality of graphics, said graphics corresponding to specific areas on said target device;

c) a controller 40 operatively connecting said target device 12 and said DTDR to a microprocessor 42, and a memory device 43; said memory device 43 further comprising of ROM 44 for software code storage and RAM 45;

d) an input device 46 to detect game option selections by a user operatively connected to said controller 40 including a start game button to begin play;

e) an information screen 110 to display game options rules, and scores operatively connected to said controller 40;

wherein said microprocessor 42 loads stored game programs from said ROM 44 and a game selection menu system; said game selection menu system allowing said user to select a game type and a game level from said information screen 110 using input device 46, said user selections being stored in said RAM 45;

wherein said game type and game level selections sequentially increment respective counters with each press of a selection button on said input device 46 to scroll through and display index numbers indicative of said game type and game level for display on said information screen 110; and wherein said game programs include graphics files of images corresponding to said selected game type and game level for display on said DTDR via a display driver circuit 47;

wherein the target device comprises scoring segments, wherein the scoring segments comprises:

a) a bull's-eye 15, b) a first area (single ring) 16 surrounding the bull's-eye, wherein the first area comprises a plurality of scoring segments, c) a second area (triple ring) 17 surrounding the first area, wherein the second area comprises a plurality of scoring segments, d) a third area (single ring) 18 surrounding the second area, wherein the third area comprises a plurality of scoring segments, e) a fourth area (double ring) 19 surrounding the third area, wherein the fourth area comprises a plurality of scoring segments, and wherein the scoring segments are radially aligned within twenty pie sections, wherein the target device contains electronic sensors connected to each pie segment, capable of detecting a dart strike and sending a signal corresponding to the dart strike area to the controller;

wherein said DTDR displays twenty sectional graphics, wherein each sectional graphic corresponds to a pie section;

wherein the input device contains a "manual" input, which may be actuated by the user, whereupon the input device sends a signal to the microprocessor, where the microprocessor is configured such that upon receiving the signal from the input device, the microprocessor enters a mode that permits the user to assign the graphics, where the means of assigning the graphics is by tapping sectional areas of the target device with a dart in a series, where upon tapping a sectional area with a dart, the microprocessor assigns a graphic from a list of twenty available graphics to the sectional area tapped, according to a counter, whereupon the counter is incremented from one to twenty upon each tap of the dart.

2. An interactive multifunctional dart board system programmable to play a plurality of games, the system comprising:

a) a target device 12 to receive dart impact signals on a dart impact area;

b) a digital target display ring (DTDR) surrounding the target device 12 to display a plurality of graphics, said graphics corresponding to specific areas on said target device;

c) a controller 40 operatively connecting said target device 12 and said DTDR to a microprocessor 42, and a memory device 43; said memory device 43 further comprising of ROM 44 for software code storage and RAM 45;

d) an input device 46 to detect game option selections by a user operatively connected to said controller 40 including a start game button to begin play;

e) an information screen 110 to display game options rules, and scores operatively connected to said controller 40;

wherein said microprocessor 42 loads stored game programs from said ROM 44 and a game selection menu system; said game selection menu system allowing said user to select a game type and a game level from said information screen 110 using input device 46, said user selections being stored in said RAM 45;

wherein said game type and game level selections sequentially increment respective counters with each press of a selection button on said input device 46 to scroll through and display index numbers indicative of said game type and game level for display on said information screen 110; and wherein said game programs include graphics files of images corresponding to said selected game type and game level for display on said DTDR via a display driver circuit 47;

wherein the target device comprises scoring segments, wherein the scoring segments comprises:

a) a bull's-eye 15, b) a first area (single ring) 16 surrounding the bull's-eye, wherein the first area comprises a plurality of scoring segments, c) a second area (triple ring) 17 surrounding the first area, wherein the second area comprises a plurality of scoring segments, d) a third area (single ring) 18 surrounding the second area, wherein the third area comprises a plurality of scoring segments, e) a fourth area (double ring) 19 surrounding the third area, wherein the fourth area comprises a plurality of scoring segments, and wherein the scoring segments are radially aligned within twenty pie sections, wherein the target device contains electronic sensors connected to each pie segment, capable of detecting a dart strike and sending a signal corresponding to the dart strike area to the controller;

wherein said DTDR displays twenty sectional graphics, wherein each sectional graphic corresponds to a pie section;

wherein the input device includes a "random" input which will randomize selection of the sectional graphics on the board, where upon actuation of the "random" input, the input device sends a signal to the microprocessor, where the microprocessor is configured such that upon receiving the signal from the input device, the microprocessor generates a random ordering for the graphics, whereupon the microprocessor sends a signal to said DTDR to display the graphics in an arrangement selected.

3. An interactive multifunctional dart board system programmable to play a plurality of games, the system comprising:

a) a target device 12 to receive dart impact signals on a dart impact area;

b) a digital target display ring (DTDR) surrounding the target device 12 to display a plurality of graphics, said graphics corresponding to specific areas on said target device;

c) a controller 40 operatively connecting said target device 12 and said DTDR to a microprocessor 42, and a memory device 43; said memory device 43 further comprising of ROM 44 for software code storage and RAM 45;

d) an input device 46 to detect game option selections by a user operatively connected to said controller 40 including a start game button to begin play;

e) an information screen 110 to display game options rules, and scores operatively connected to said controller 40;

wherein said microprocessor 42 loads stored game programs from said ROM 44 and a game selection menu system; said game selection menu system allowing said user to select a game type and a game level from said information screen 110 using input device 46, said user selections being stored in said RAM 45;

wherein said game type and game level selections sequentially increment respective counters with each press of a selection button on said input device 46 to scroll through and display index numbers indicative of said game type and game level for display on said information screen 110; and wherein said game programs include graphics files of images corresponding to said selected game type and game level for display on said DTDR via a display driver circuit 47;

wherein the target device comprises scoring segments, wherein the scoring segments comprises:

a) a bull's-eye 15, b) a first area (single ring) 16 surrounding the bull's-eye, wherein the first area comprises a plurality of scoring segments, c) a second area (triple ring) 17 surrounding the first area, wherein the second area comprises a plurality of scoring segments, d) a third area (single ring) 18 surrounding the second area, wherein the third area comprises a plurality of scoring segments, e) a fourth area (double ring) 19 surrounding the third area, wherein the fourth area comprises a plurality of scoring segments, and wherein the scoring segments are radially aligned within twenty pie sections, wherein the target device contains electronic sensors connected to each pie segment, capable of detecting a dart strike and sending a signal corresponding to the dart strike area to the controller;

wherein said DTDR displays twenty sectional graphics, wherein each sectional graphic corresponds to a pie section;

wherein the input device contains a "level" input which chooses the game level, where upon actuation of the input the input device sends a signal to the microprocessor, where the microprocessor is configured such that upon receiving a signal from the input device, the microprocessor will modify the game level variable stored in RAM, where the game level variable determines a manner in which sectional graphics displayed upon said DTDR are modified following specified game events, where the microprocessor is configured to detect game events during play according to signals received from the target device and the input device, where upon a specified game event during game play the microprocessor sends a signal to said DTDR to modify the displayed sectional graphics, according to the manner specified by the game level.

* * * * *